US005953774A

United States Patent [19]

Arndt

[11] Patent Number: 5,953,774

[45] Date of Patent: Sep. 21, 1999

[54] FRONTALLY INSERTABLE BODY HOIST SEAT AND SLING ASSEMBLY

[76] Inventor: Robert L. Arndt, 424 S. Lexington Pkwy., DeForest, Wis. 53532

[21] Appl. No.: 08/893,854

[22] Filed: Jul. 11, 1997

[51] Int. Cl.[6] ..... A61G 7/10; A61G 7/14; A61G 7/12

[52] U.S. Cl. ..... 5/86.1; 5/81.1 R

[58] Field of Search ..... 5/86.1, 81.1 R, 5/83.1–88.1

[56] References Cited

U.S. PATENT DOCUMENTS

| | | | |
|---|---|---|---|
| 3,608,104 | 9/1971 | van Gerven | 5/83.1 |
| 3,629,880 | 12/1971 | van Rhyn | 5/86.1 |
| 3,790,974 | 2/1974 | Johansson | 5/86.1 |
| 3,829,916 | 8/1974 | James | 5/86.1 |
| 4,574,410 | 3/1986 | Lassmann et al. | 5/85.1 |
| 4,633,538 | 1/1987 | James | 5/86.1 |
| 4,875,555 | 10/1989 | Johansson et al. | 5/86.1 |
| 5,153,953 | 10/1992 | Sumrall | 5/86.1 |
| 5,619,762 | 4/1997 | Mein | 5/86.1 |

*Primary Examiner*—Alex Grosz
*Attorney, Agent, or Firm*—Loyd W. Bonneville

[57] ABSTRACT

Seat and sling hanger assembly for attachment to a body hoist by which a paraplegic or other debilitated subject may be transported in an erect, near standing posture

10 Claims, 5 Drawing Sheets

FRONTALLY INSERTABLE BODY HOIST SEAT AND SLING ASSEMBLY

BACKGROUND OF THE INVENTION

1. Field of the Invention

Body hoist accessories

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term hanger's anterior attachment site (4) might be used in one instance but in another, if meaning is otherwise clear from context, expression might be shortened to anterior attachment site (4) or merely attachment site (4). Any of those forms is intended to convey the same meaning.

The term emplace or any of its forms when used in this application means the joining of two objects or parts so as to unite them in a reasonably easily removable way, such as the connection of a body sling connector to a sling connection pin (13), ante. The word emplace is also consistent in meaning with the word "detachable" as occasionally used in connection parlance but not in this application, since it is derived from the root attach. The term attach or fasten or any of their forms when so used means that the juncture is of a more or less permanent nature, such as might be accomplished by nails, screws, welds or adhesives. Employment of the words connect or join or any of their forms is intended to include the meaning of both in a more general way.

The antonyms anterior and posterior herein when applied to an invention member, are intended to designate a part thereof with reference to a human subject (100) using the invention. Thus, the anterior end (17) of the seat (1, described ante) is that at the front of the subject (100) using it and the posterior end (18) is that which is behind him or her. The antonyms proximate and distal are intended to have dispositional reference of a point with reference to the hoist's mast (56, described ante). The antonyms inward and outward and any of their word forms are also employed with reference to the mast (56). The anterior end of the seat (1) is, then, also the proximate or inward end, thereof since it is nearer the mast (56) than the posterior or outward end thereof (1), which is also more distal the mast (56).

The term debilitated, herein is meant to include not only a paraplegic, but an invalid such as a hospital, nursing home or home health care patient who has limited or no ability to use the lower part of the body.

A conventional or prior art body hoist, typically and by definition herein, is a device comprised of a hoist mast (56), a cantilevered load arm (51) suspended outward from it (56), a stabilizing base and operative means for raising and lowering the load. While there are models suspended from a ceiling and operable upon a system of overhead rails from which the mast extends downwards, they are most often situated and operate upon a floor.

The operative means of elevational control may comprise nothing more than a hand crank and suitable gearing to raise and lower the load arm (51). More recently, motorized means have been substituted for the manual crank. The base is constructed so as to provide stability to a load suspended from a sling attachment site (52) at the load arm's (51) distal end--that is, that farthest from the hoist mast (56) from which it (51) extends.

Any reference to a hoist's cantilevered load arm (51) herein requires that it (51) be capable of being operatively raised and lowered in one manner or another. Hoists comprising a load arm (51) whose direction of movement is limited to vertically up and down along the mast (56) exist. Another existing hoist structure raises and lowers the distal end of the load arm (51) pivotably from the mast (56), describing an arc over the range of the angles subtended. The angular range from horizontal is designated $\beta$, discussed further ante. The hoist whose load arm (51) is capable of solely vertical elevational movements, as distinguished from those which may be made pivotably, requires that the mast (56) extend higher to allow sufficient clearance from the floor for a sling hung from the arm (51).

The sling is itself typically comprised of strong fabric or netting in which the subject (100) is enclosed and supported. The means of suspension often comprise connectors to the attachment site (52) such as chain work and snap hooks. Generally, the sling may be rotated or twisted to manipulate the orientation of the subject's body. In some instances, a sling is vital to raising a fallen subject.

Suspension of the subject (100) in cantilever fashion presents a tipping hazard which must be overcome in the hoist's design. Stability has been addressed in various ways. Most directly, that objective has been met by making the base heavy enough to overcome leverage exerted by the load. Sometimes the hoist has been constructed with means to fasten it to a hook in the floor proximate the area of care. Base frame limbs (57) also have been extended along the floor to create an area within which it is intended the center of gravity of the load above be aligned (81). The limbs (57) have sometimes been constructed so as to provide for a rectangular area (81). They (57) have also been made to extend straightly from the mast (56) at angles forming a triangle (81) for support. Castored wheels (58) disposed beneath the base limbs (57) to enhance hoist mobility have been situated at their proximate (60) and distal (59) extremities because of the tipping leverage exerted against the points the wheels (58) contact the floor. Provision of a suitable area of base stability (81) has been the object of all of those measures.

The space beneath the attachment site (52) of any hoist must permit moving the sling close to places useful for the subject's (100) care such as a chair, bed, toilet stool, bathtub and other confining places. More recently, the base limbs (57) with reference to one another have been made adjustable so as to permit operation of the hoist in such locations. However, spreading the base frame limbs (57) too widely shortens the distance across the center of gravity to the area of stability's (81) distal perimeter, thereby altering the leverage factor and making the hoist more apt to tip. There are, therefore, practical limits to the degree the limbs may be spread.

The operational controls for the hoist may be situated within reach of any subject (100) capable of using them. In any instance in which such construction presents the subject (100) a significant safety hazard, however, the controls should be situated out of his (100) or her (100) reach.

Devices to assist the debilitated are varied in structure and function. U.S. Pat. No. 5,353,593 issued to Sumrall consists of a wheeled framework with means to lift the subject (100) and his or her seat pad from and permit the withdrawal of a wheelchair, wheeling subject (100) and pad into position for reseating inside an automobile. The structure includes an upper support for the subject (100) to lean upon. U.S. Pat. No. 4,875,555 issued to Johansson, et al features an automatic shut-off mechanism for a battery driven jack which lifts and lowers a seated subject (100). U.S. Pat. No. 4,633,538 issued to James employs a chair seat with focus upon light weight construction made possible by relocating a battery driven motor from the top to the bottom of a detachable column. U.S. Pat. No. 4,574,410 issued to Lassmann, et al illustrates a seat cantilevered from a vertically rotatable column extending from a base which may be anchored to the floor. The seat may be raised or lowered and may itself be repositioned by rotating it upon a horizontal axis and moving its backrest along a slide bar. U.S. Pat. No. 3,829,916 issued to James comprises a legless chair cantilevered from a column along which it may be raised and lowered and around which it may be rotated. U.S. Pat. No. 3,790,974 issued to Johansson features a seat insertable between the legs from the subject's front and includes elbow rests and means to support the feet for complete body support. The control for raising and lowering the seat along its mast (56) is located within reach of the subject (100). There is no provision for a sling, however. U.S. Pat. No. 3,620,880 issued to Van Rhyn comprises a device operable by the subject (100) with plates which simultaneously support the buttocks from behind and knees from the front as he (100) or she (100) arises from seated to standing. U.S. Pat. No. 3,608,104 issued to Van Gerven illustrates a frame with appendages which hook under the subject's (100) thighs and shoulders in selected positions to orient the subject (100) in either a sitting or semireclining position, primarily to permit the feet to clear the edge of a bathtub for placement therein.

All of the foregoing feature in common a seat (1) which may be raised and lowered or otherwise repositioned. Only the Johansson body hoist shares with applicant's invention the function of insertion and withdrawal of a seat (1) from the front between the subject's (100) legs. However, the Johansson device differs not only in excluding sling connection means but in providing support to the subject's (100) feet during transport. The subject (100) must, therefore, be situated passively in seated posture and transported without having the legs extended to the floor as one may do when posture is erect. The Johansson device also differs from some embodiments of applicant's invention in requiring that elevational adjustment of the load arm (100) be limited to directly vertical, as distinguished from vertically pivotable, ante.

There is a need in transport of permitting the subject (100) to be oriented seated erectly, as though standing, thereby providing a measure of psychic benefit not possible when he (100) or she (100) is postured cramped, bent over or in a lying position. It has been recognized that a man or woman who stands or sits erectly expresses proud demeanor and derives a beneficial measure of health from the experience. It is often a debilitated human's demoralization which impairs him or her the most.

This application, ante, describes a device which simultaneously provides a subject (100) with both upper and lower torso lifting force. Some human subjects, some quadriplegics for example, do not tolerate well being lifted in a manner such that part of the lifting force is applied beneath the armpits. There is, therefore, a need for a device which provides not only for such two point lifting but a sling as well as a lifting alternative.

There is a further need of allowing foot-to-floor contact for the subject (100), permitting him (100) or her (100), if able, to participate with the attendant in transport. It may also provide a degree of rehabilitation and exercise. At a minimum, however, foot-to-floor contact permits the subject (100) to cooperate even passively with the attendant by providing a degree of stability during transport not otherwise available. Those needs or objectives thus far remain unaddressed in the prior art.

SUMMARY OF THE INVENTION

The invention is an improvement to and requires modification of a conventional body hoist employed in the care of a paraplegic (100) or other debilitated human subject (100). It comprises a seat (1) attached to a body hoist's cantilevered load arm (51), in some embodiments by means of an intermediate hanger (2). While allowing for connection of a body sling, the seat (1) permits an alternative mode for a subject's (100) transport by means other than the sling.

The seat (1) is shaped so that it is frontally insertable—that is, can be slid or inserted from in front of a subject (100) seated upon a chair, toilet stool or bed, between his (100) or her (100) legs and beneath the buttocks.

A thorax support carriage (8) is also included as an upper body supporting locus upon which the subject (100) can pull himself (100) or herself (100) into position during mounting and derive secure support during transport. Hand grips, such as those upon the handlebars of a bicycle, or armpit support pads (9) may be attached to the carriage (8).

The hoist is then conventionally operated to raise and transport the subject (100) so that he (100) or she (100) may participate in the activity by means of foot-to-floor contact while being supported in an erect, upright, near standing, posture.

Upon arriving at the destination of transport, the subject (100) is lowered in like manner into an intended position for care.

A sling connection pin (13) disposed at the anterior end of the seat (1) is brought into play by raising the seat (1) to or near its maximum elevation, where sling connectors may be emplaced upon it. Means are provided to displace the connection pin (13) and, therefore, the center of gravity of a loaded sling, inwards into an area of base stability (81).

The invention may also be employed in the above manner for rehabilitation purposes. It permits transport in appropriate instances without foot-to-floor contact by the subject (100). By lowering the seat to floor level, it may also be employed to aid in raising a fallen subject (100).

BRIEF DESCRIPTION OF THE DRAWINGS

Solid lines in the drawings represent the invention. Dashed lines represent prior art or other non-inventive material.

FIG. 2: Ready; FIG. 3: Mounted; FIG. 4: Partially elevational; FIG. 5: Erect.

DESCRIPTION OF THE PREFERRED EMBODIMENT

Figure 1:
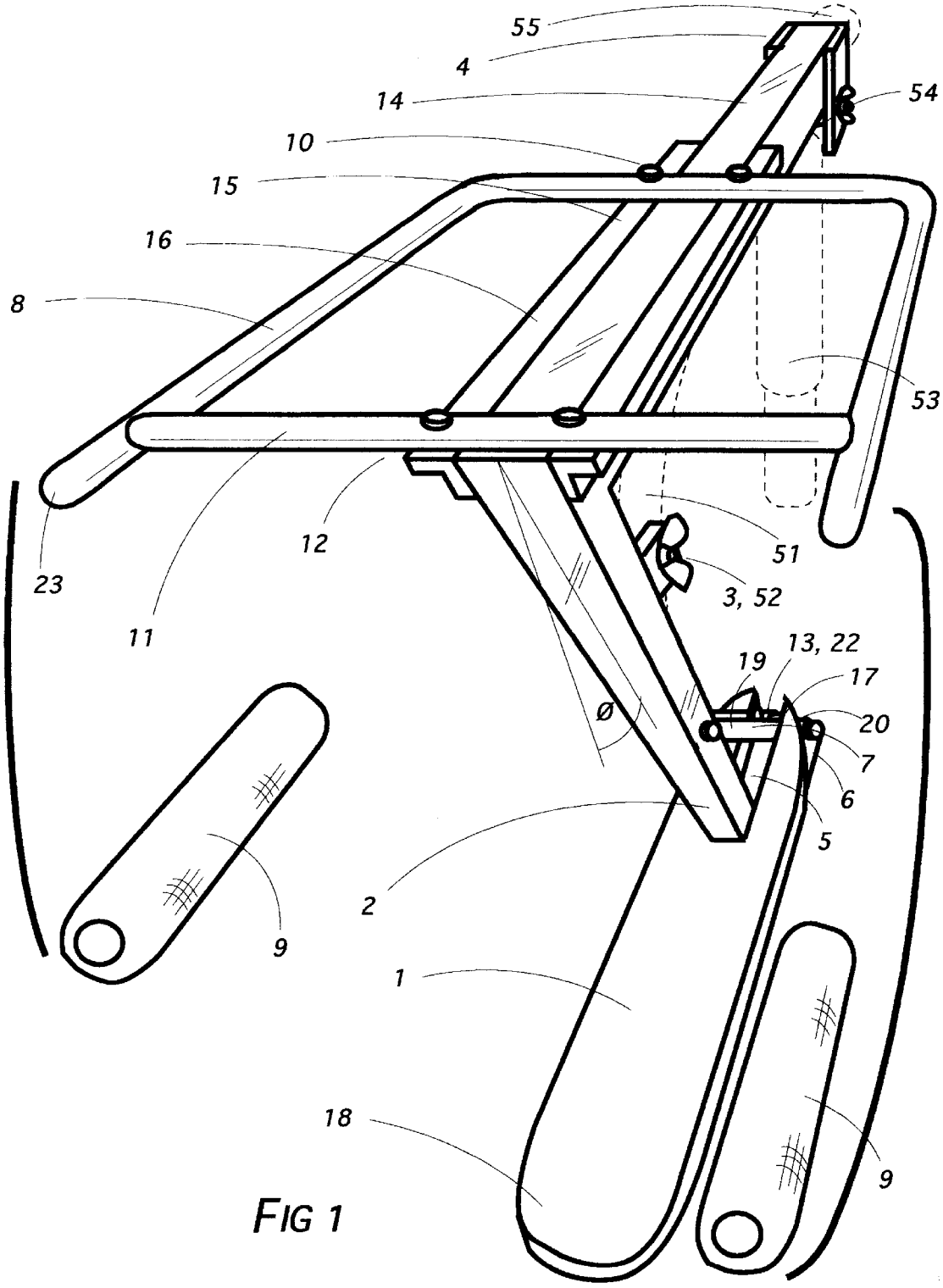
FIG. 1 represents a partially exploded perspective view of one embodiment of the invention, depicting a seat (1), a hanger (2) and a thorax support carriage (8) as primary components, various incidental members employed therewith and the respective attachment sites of the parts to certain prior art body hoist members. Armpit support pads (9) are shown displaced from their place of attachment to the support carriage (8) in order to provide an unobstructed view of other invention parts.

The invention comprises an improvement to a body hoist, a device known in the prior art as one to provide means of lifting and transporting a paraplegic or otherwise debilitated human subject (100), defined supra.

The subject matter of the invention features a seat (1) which serves as a lower torso support and a thorax support carriage (8) which serves an an upper support. The combination is attached to a mechanical body hoist of the kind used to lift a disabled or debilitated human from beds, chairs, bathtubs or toilet stool. It is particularly useful for paraplegics, disabled persons who have a functional torso but do not have full use of their lower body.

The invention may be used both to assist the subject (100) in transport from one place to another and as means to exercise the legs if they are partly functional. It meets the needs and objectives of erect body orientation, partial assistance to the attendant, cooperative body stability and torso rehabilitation set forth supra.

In certain cases, the invention could even be of benefit in transporting a quadriplegic, a disabled person who has lost use of both upper and lower parts of the body.

The invention is an improvement to and requires modification of a conventional hoist. The sling emplacement site (52) of the hoist is modified to provide means for attachment of the invention's seat (1). Other provision is made for the sling's emplacement upon the invention, ante. The invention must also be open bottomed—that is, it must not be fitted with a platform or foot rests. There must be no underlying support for the subject's (100) feet other than the floor. Any conventional hoist comprising such a structure must, therefore, also be modified in that respect.

The invention comprises an elongated seat (1) attached to the cantilevered load arm (51) of a conventional body hoist either directly or, in those embodiments comprised of one, indirectly through an intermediate hanger (2).

The hanger comprises two limbs—a load bearing one (14) and a seat supporting one (15). In embodiments comprising a hanger, means of attachment to the cantilevered arm (51) comprises bolts, welds or other known effective means. Means of attachment to the seat (1) in those embodiments may comprise a hanger attachment bracket (6) which extends along the underside of the seat (1) as shown in FIGS. 1–7. The hanger (2) is attached in turn to the hoist's cantilevered load arm (51).

The seat (1) is straddled in use. It's width (1) is sufficiently narrow to be inserted between the subject's (100) legs but wide enough to provide comfortable support beneath the buttocks. Width at the seat's posterior end (18)—that which is frontally inserted through the subject's (100) legs beneath the buttocks—should, therefore, range from three inches to one foot, most preferably approximating five inches. The seat's (1) edges are smoothed by beveling or otherwise so that its posterior end (18) slides easily underneath a subject (100) seated in a chair (75) or upon the edge of a bed. The seat's (1) length must be sufficient to extend beyond the subject's (100) posterior when seated both before mounting and after delivery and disengagement following transport. The seat (1) may be configured such that its posterior end (18) is narrower than the anterior one (18). A seat (1) of uniform width is acceptable, however, and the cost of its manufacture should, in some cases, be less than that of a tapered one.

Figure 2:
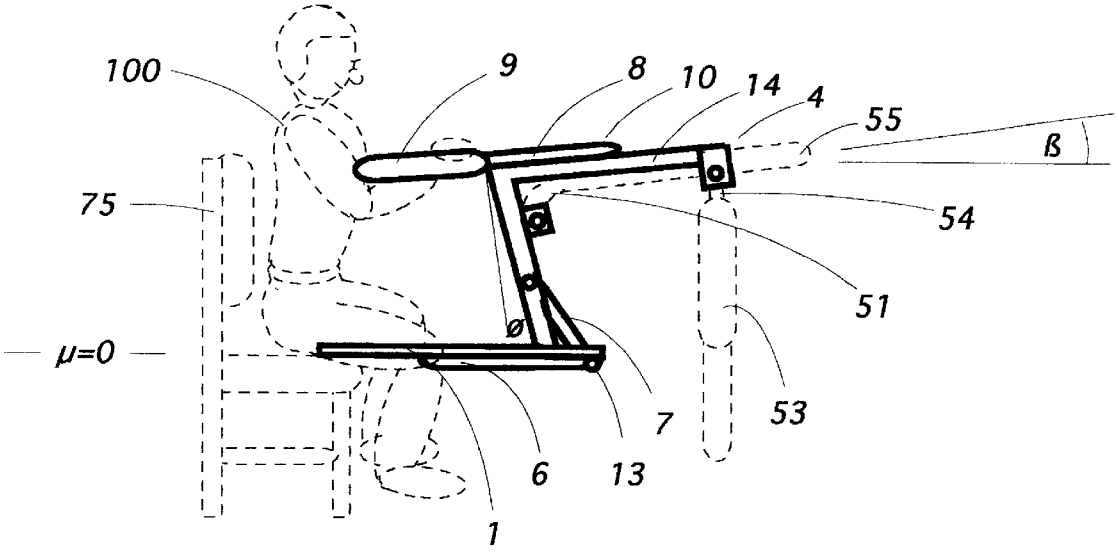
FIGS. 2–5 comprises a series of side or elevational views of that embodiment as used by a paraplegic or other debilitated human subject (100), the views addressing specifically the seat's (1) and hanger's (2) angular relationships ($\phi$and $\beta$, respectively ) with reference to horizontal at successive stages or positions of adjustment. The subject (100) is shown in the following sequential positions.

It is a simple matter to raise or lower the hoist's cantilevered load arm (51) to a height which permits the seat (1) to be so inserted beneath the subject (100) seated, for example, in a chair (75). At that point, the seat (1) in the preferred embodiment is oriented in a generally horizontal disposition. This is shown in FIG. 2, indicating that the angle of the seat (1) to the floor $\mu$, is zero. The subject (100) is allowed to move onto the seat either unassisted or, if necessary, with the attendant's help. Most paraplegic subjects (100) are capable of seating themselves once they have grasped some part of the torso support frame (8), so as to pull themselves (100) into fully seated position. Upon mounting and self positioning upon the seat (1), the subject (100) may allow part of his (100) or her (100) weight to rest upon armpit support pads (9) attached to the frame (8) or may grasp hand grips, depending upon which is included as part of the structure.

A thorax support carriage (8) is hereby defined as any designated part of the assembly comprising an upper body supporting locus upon which the subject (100) may secure himself (100) or herself (100) for body support. Thus, it (8) may comprise a pair of mere hand sized pegs extending laterally from the hoist's cantilevered arm (51). It (8) may be shaped to resemble a set of handlebars for a bicycle and permit the subject (100) to secure himself (100) or herself (100) by holding its (8) hand grips with both hands. In a preferred embodiment, however, the carriage (8) is shaped so that a portion extends beneath the subject's (100) arms, allowing the upper body's weight to rest upon it (8). Besides the support it (8) provides for the thorax, it (8) also offers a grasping locus permitting the subject (100) to pull himself (100) or herself (100) upon the seat (1) during mounting as well as allowing for comparable security during disengagement at the destination site.

Armpit support pads (9) are preferably attached to an armpit carriage extension (23)—the part of the carriage (8) most proximal the subject (100)—a part thereof (8) upon or along which his (100) or her (100) arms are disposed during use and which (23) extends beneath and through the armpits. The carriage extensions (23) must be configured to support considerable body weight. The pad (9) may, therefore, be configured so that its (9) entire length slides upon solid or tubular extensions (23) or may be reinforced by a rigid interior secured to the carriage (8) by other conventional means.

Preferably, armpit support pads (9) and armpit carriage extensions (23) are included as part of the thorax support carriage's (8) structure and two—one for each arm—should be provided in each case (9, 23). In some instances, the armpit carriage extension (23) extends straightly from the thorax support carriage. In a preferred embodiment, however, illustrated in FIG. 9, each extension (23) and each pad's (9) posterior extremity (21) is configured with a "C" shaped bend. The phrase "C" shaped bend does not extend in meaning to any curve but is limited in meaning to express as objectively as possible a contour approximating that of a human subject's armpit and proximal shoulder area. Thus, for the sake of objectivity, it is preferable that while the bend need not be perfect in roundness such as the shape of part of a circle, it should preferably comprise an arc whose radius ranges between four and nine inches in measurement. Such construction enhances the subject's security and provides greater comfort during lifting and transport.

Figure 9:
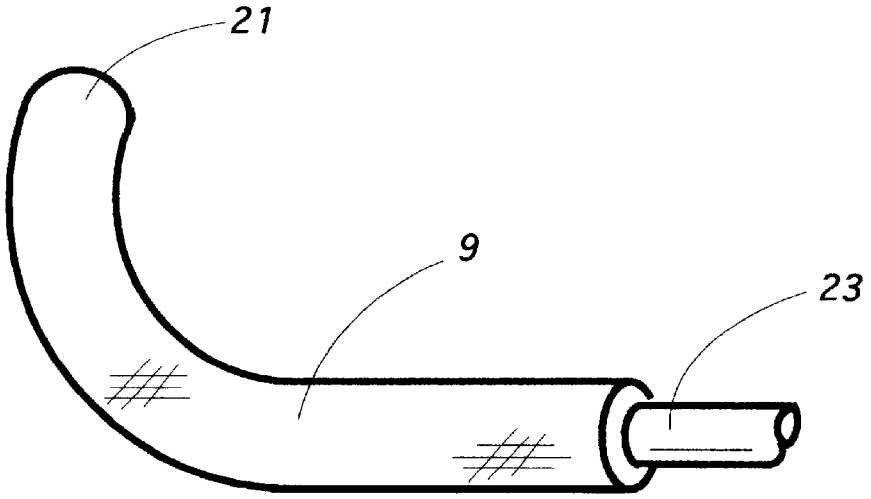
FIG. 9 depicts an armpit carriage extension (23) and an armpit support pad (9) fitted over it, the extension (23) and posterior end of the pad (9) comprising a "C" shaped bend of curvature, the size and shape of which (23) is intended preferably to approximate that of a human subject's armpit and proximal shoulder area.

The bend contemplated herein also includes one which is displaced from tangential disposition such as that depicted in FIG. 9, to one which is situated slightly downward so that a pocket-like depression is formed within which the subject's (100) armpit may become seated for support. Preferably, such displacement should vary between one-quarter and three-quarters of an inch. It would, of course, be ideal for the curvature of the "C shaped bend" referred to herein to conform to the curvature of the subject's (100) armpit and proximal shoulder area. To avoid the use of language too subjective and to accommodate the varying curvatures for different subjects (100), that terminology is meant herein to encompass the configurations and range of dimensions recited just supra.

Thus, as the seat (1) is sliding into place and afterwards, the subject (100) may rest the weight of his (100) or her (100) thorax upon the carriage (8). Preferably, the carriage (8) also comprise a cross brace (11) fastened to the hoist's load arm (51) or to a hanger (2), in an embodiment in which one is present, at a thorax support carriage attachment site (10).

Figure 8:
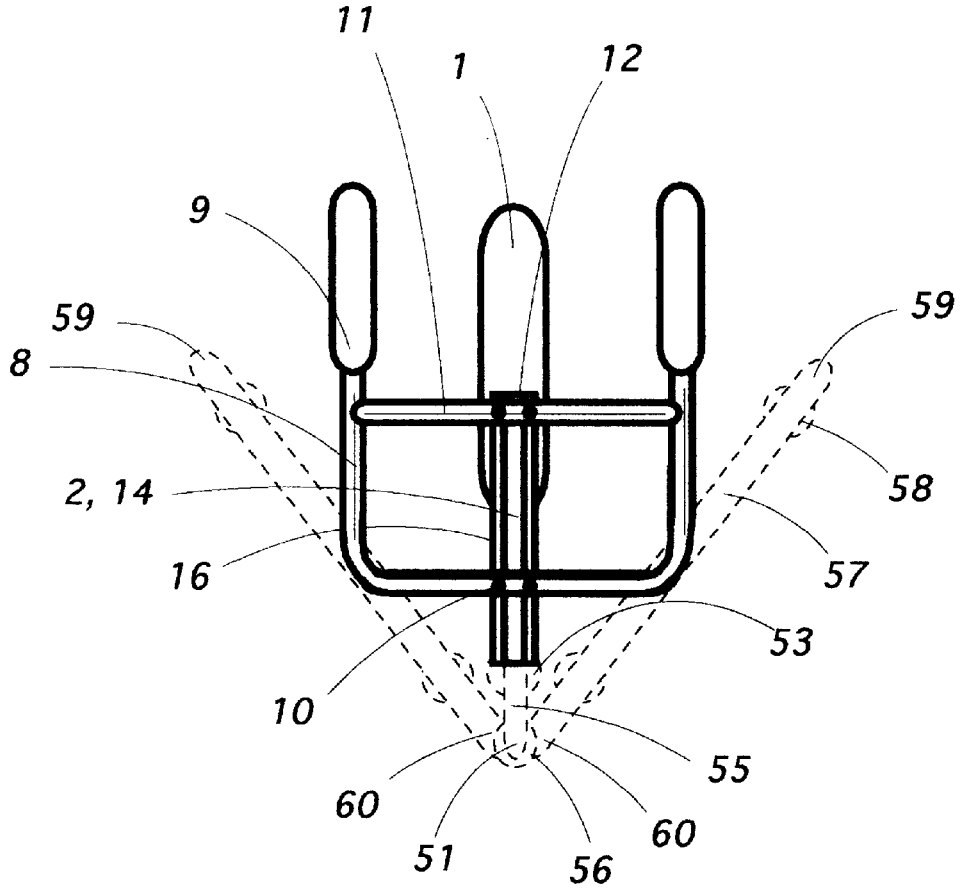
FIG. 8 is an overhead or plan view of a typical embodiment of the invention illustrating a triangular area of base stability (81) within or proximate which the invention disposes the center of gravity of its load, whether the subject (100) is situated upon the seat (1) or suspended from the sling connection pin (13).

The support carriage (8) is strengthened by a cross brace (11) fastened to the hanger (2) at a brace attachment site (12). Attachment of both the carriage (8) and the brace (11) is made more reliable by employing anchoring angle bars (16) for attachment to the hanger (2) as shown in FIGS. 1 and 8 and disposing the attachment means—bolts, welds or other known connectors—for fastening to the angle bars (16), rather than into the often narrow hanger (2) itself.

As the seat (1) is inserted, the subject (100) leans forward upon the thorax support carriage (8), deriving support from it (8) and grasping (8) it in a manner which permits him (100) or her (100) to be pulled fully onto the seat (1). Next, the load arm (51) is further raised and withdrawn outward from the chair (75) to lift the subject (100) just high enough to permit his (100) or her (100) toes or the bottoms of the feet to extend to and rest upon the floor. At this point, in the preferred embodiment, the posterior end (18) of the seat—that behind the subject (100)—is oriented upwards at an angle slightly from the horizontal, the angle subtended by the seat (1) shown as p in FIG. 4, an angle which had been zero during preparation for mounting. This orientation of the seat (1) provides a measure of stability in that body weight is directed slightly forward and within the area of base stability, ante.

Figure 3:
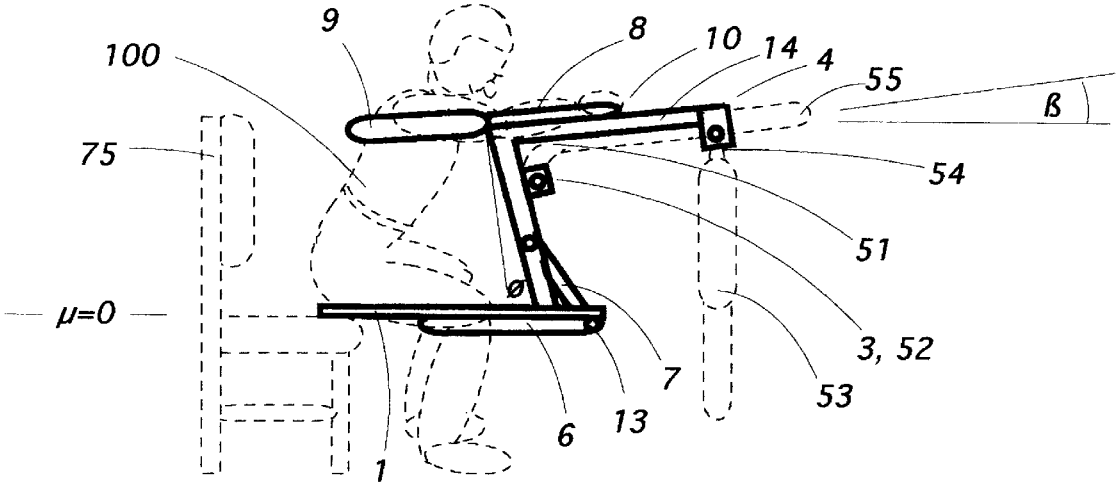
Figure 4:
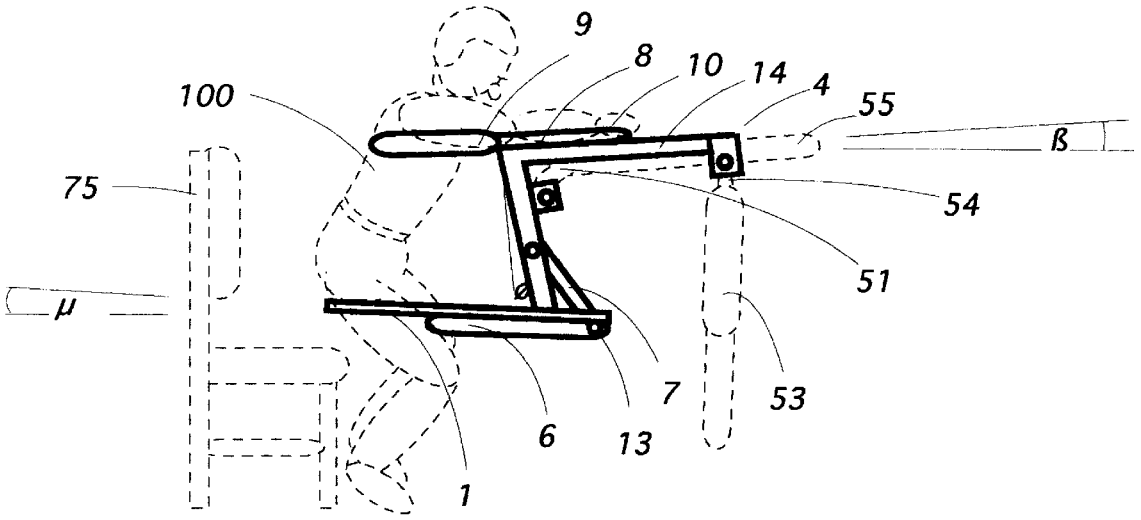
Figure 5:
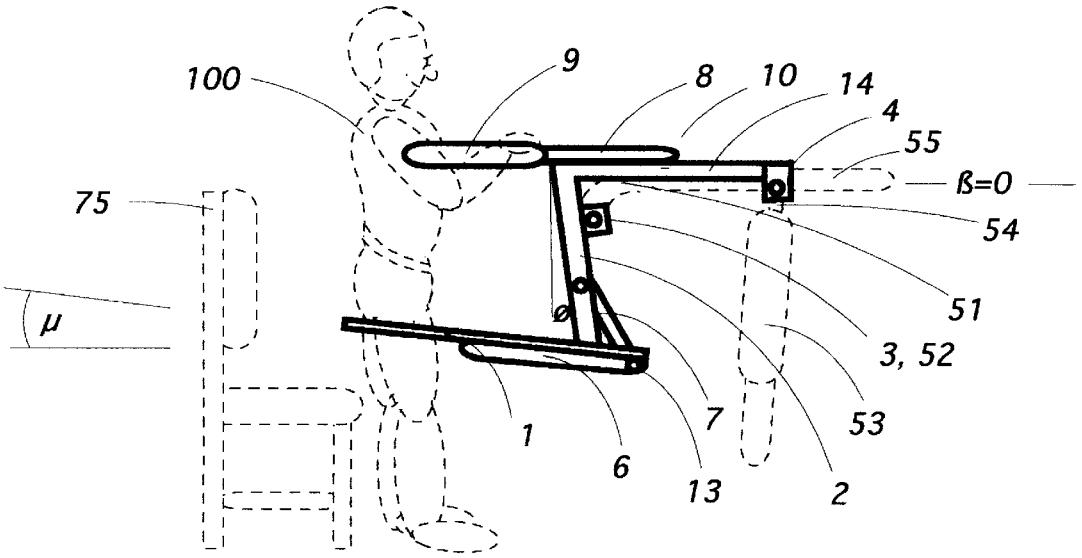

Such is the arc subtended by the angle $\mu$. However, in the preferred embodiment, the angle of inclination or declination, $\beta$, of the hanger's load bearing limb (14)—that is, with reference to horizontal—changes from the positive value it had before preparation for mounting to approach zero. That angle is depicted in FIG. 4 and the extent to which it has diminished from what it had been in FIGS. 2 and 3 is readily apparent. During mounting operation, angle $\beta$ will eventually reach zero, a position which will offer the subject (100) a more comfortable arm and hand position when he (100) or she (100) is supported in a near or fully erect position.

Having become fully seated, the subject (100) may now be raised to the erect position. At this point, his (100) or her (100) weight may be allowed to attain partial support upon the floor either upon the toes or flatly upon the soles of the feet.

In certain instances, it may be necessary to transport the subject (100) with his (100) or her (100) entire weight borne by the seat (1)—that is, with the feet entirely suspended off the floor. When the seat (1) is being raised, the angle subtended by $\mu$ increasing upwards from horizontal, care must be exercised to assure that the angle is never brought to a point a seated subject's (100) safety is impaired. Although the height of the hoist's load arm (51) and the invention attached to it may be increased substantially, as explained ante, such an elevated position is intended only for use of a sling.

At this point, although the subject's (100) weight is borne partly by the thorax support carriage (8) and partly by by contact of the feet with the floor, all other underlying support is imposed upon the seat (1). It is important that the center of gravity of the load borne by the hoist's load arm (51) not be so distally disposed to the hoist's mast (56) that it tends to tip the hoist over. The load's center of gravity should be disposed generally above the area of base stability (81), provided in a preferred embodiment by the base frame limbs (57). This area (81) may be conceived in FIG. 8 as the triangle on the floor connecting the points between the hoist mast (56) and the distal ends (59) of the frame—that is, at the respective ends of the limbs (57). If wheels (58) are present, it should be recognized that the corners of the area of stability (81) are designated by the points of wheel contact with the floor. and, as mentioned supra, it is for that reason that the wheels are located at or near the extremities of the base frame limbs (57).

Although a hoist comprises substantial weight, If the load's center of gravity falls too far outside of the area of stability (81), a triangle in a preferred embodiment, the consequent leverage exerted against the hoist will tip it, endangering the subject (100).

Now the seated subject (100) may be transported to an intended destination—his or her bed, the bathtub or a toilet stool, for example. While the hoist is provided with wheels (58) for mobility, considerable effort is required to push it along the floor. If the subject (100) is capable of doing so, he (100) or she (100) may be of some assistance by exerting foot force against the floor. Even if he (100) or she (100) cannot so participate in transport, however, the foot-to-floor contact, as mentioned supra, offers a degree of stability to prevent tipping to one side or the other and, when necessary, helps orient the subject (100) to a suitably acceptable upright posture.

Once the destination has been reached, the process is reversed and the subject (100) is lowered onto or into the intended place.

Figure 7:
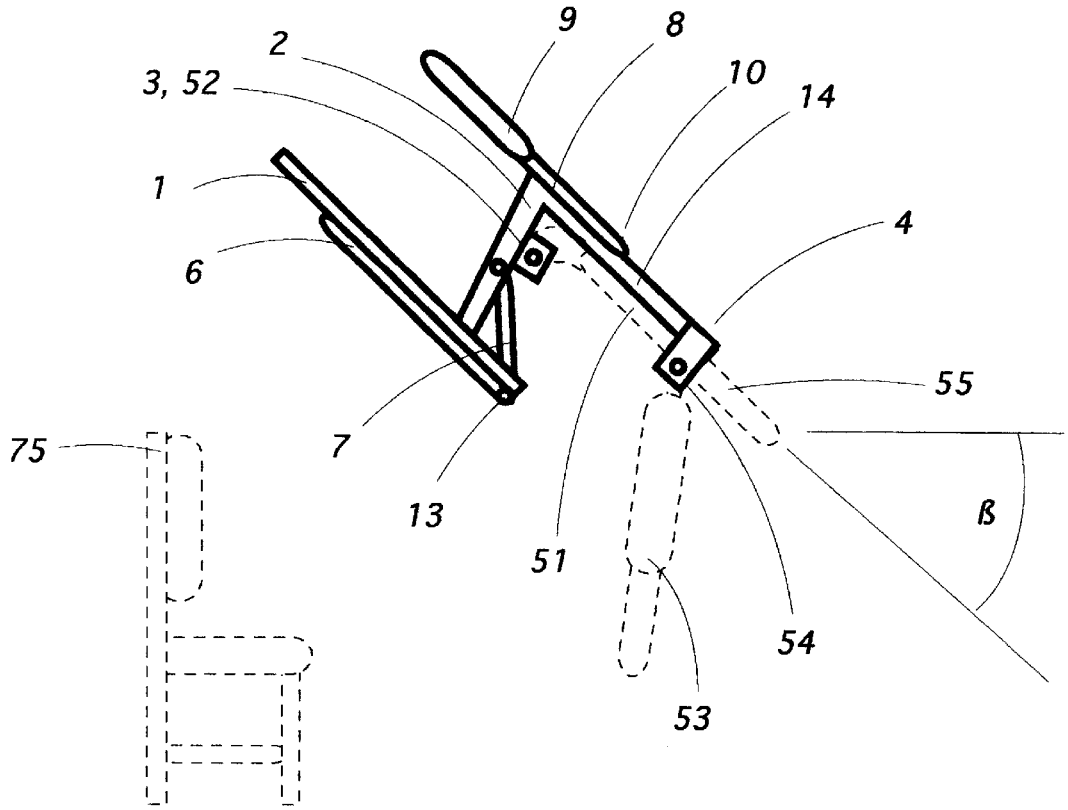

In a preferred embodiment in which a seat hanger (2) is included as part of structure, it (2) is fastened to the load arm (51) at anterior and posterior attachment sites (4 and 3, respectively). What was the load arm's sling emplacement site (52) on a body hoist prior to modification in construction of the invention is utilized by applicant in certain preferred embodiments as the hanger's posterior attachment site (3). References herein addressing that site on an unmodified hoist bear the number (52). The sling's former site (52) having been usurped for modification, other provision has been made in these embodiments for sling emplacement. The invention is comprised of a sling connection pin (13) disposed at a sling connection site (22) situated at a selected point at or near the anterior end of (17) and beneath the seat (1). This pin (13) may be brought into operable position by raising the cantilevered arm (51) to or near its maximum height as illustrated in FIG. 7.

Figure 6:
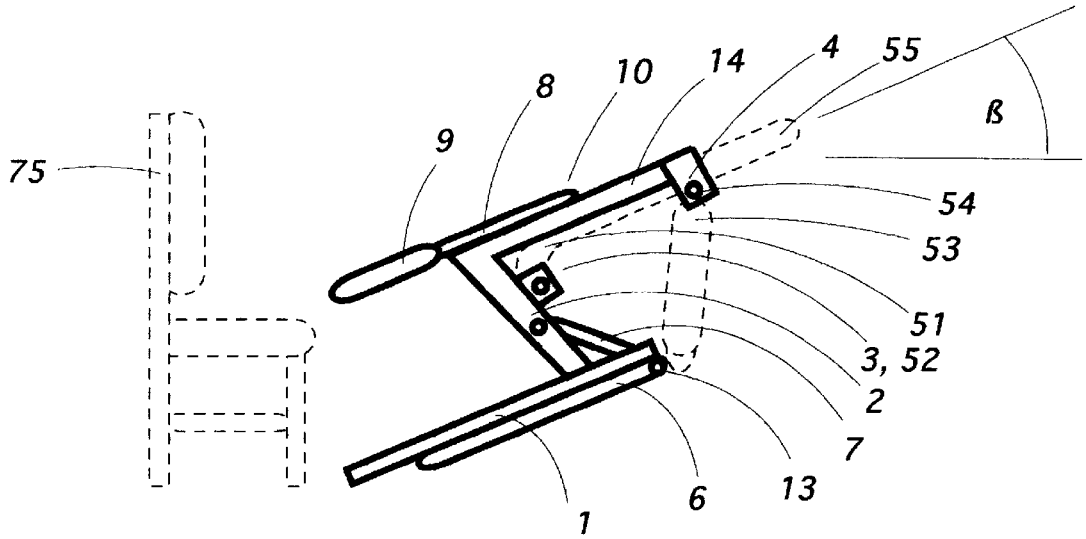
FIGS. 6 and 7 show in elevation view the extreme positions that embodiment of the invention over the body hoist's entire range of vertical angular adjustment, beginning with the seat's (1) disposition proximate the floor and ending in the raised position disposing a sling connection pin (13) in position for use.

In order to suspend a sling carried load well into alignment with the area of base stability (81) discussed supra and depicted in FIG. 8, the hanger (2) is crooked to an acute angle, $\phi$. Such preferred construction results in an anterior shift of the center of gravity of a subject (100) enclosed and supported by a sling, bringing the weight more within the area of base stability (81) than is the case with an uncrooked hanger (2). Similarly, situating a displacement projecting finger (7) inwardly of the seat's (1) anterior end (17) provides a sling connection site (22) permitting the sling connection pin (13) to be brought even farther inward as indicated in FIGS. 1, 6 and 7, adding to the total effect. The displacement projecting finger (7) is attached at a posterior end (19) to the hanger (2), preferably to it's seat supporting limb (15), and may be attached at an anterior end (20) to the hanger-to-seat attachment bracket (6), which is disposed to extend inwardly from the seat's anterior end (17) just for such purpose.

Both the hanger attachment bracket to the seat (6) and the displacement projection finger (7) may be constructed in duplicate pairs, the members of which attach in side-by-side manner. Thus, each member of the finger (7) pair may be made to attach at its posterior end (20) to an opposite side of the hanger (2) and at its anterior end along an opposite side of the recess (5) at the seat's anterior end (17), each to a separate member of the hanger-to-seat attachment bracket (6). A single membered projection finger (7) may be configured for attachment to each member of the seat's attachment bracket (6). If such configuration is adopted, it would be a simple matter to notch the finger's (7) most forward end to allow space for the sling connection pin (13). Dual, or paired, construction simplifies manufacture and is depicted in FIG. 1.

The seat (1) may be made to also extend inwardly to cover the otherwise exposed connection site between the finger (7) and the seat attachment bracket (6). Since such an inward extension of the seat (1) would otherwise cause it to interfere with the hanger's seat supporting limb (15), a recess (5) may be disposed in the seat's anterior end (17) to permit the hanger's limb (15) to pass through as shown in FIGS. 1 and 8. Inward extension of the seat's anterior end (17) also provides an alternative attachment site for the finger's anterior end (20). So employing it (17) to that end does not, however, obviate construction of the recess (5), which even in that case must accommodate passage of the seat supporting hanger limb (15) disposed inward as part of the hanger's crooked disposition. However, if the seat (1) is permitted to project inward in the manner described, the finger (7) may be attached to it (1) at its (7) intersection with it (1) as indicated in FIG. 1, thereby comprising the finger (7) also a convenient brace for the seat (1).

The net result of the foregoing construction is to displace the sling connection pin (13) and, therefore, the load's center of gravity well into the area of base stability (81).

The crooking of the hanger (2) not only accommodates the load of a subject (100) enclosed and supported in a sling but disposes the seat (1) and, therefore, the center of gravity of a seated subject (100), farther inward than would otherwise be the case.

The invention may be employed to assist raising a fallen subject (100). FIG. 6 depicts the seat's anterior end (13) disposed at floor level.

I claim:

1. A frontally insertable body hoist seat and sling assembly, the assembly comprising:

an elongated seat attached to a conventional operable cantilevered load arm extending from the mast of an open bottomed body hoist; the seat comprising an anterior end;

a posterior end; and width at its posterior end comprising a range of from three inches to one foot permitting frontal insertion thereof between the legs underneath the buttocks of a human subject;

the assembly further comprising a thorax support carriage; and a sling connection site disposed at the seat's anterior end;

whereby when the seat is operatively raised and lowered a first selected distance from the floor, it supports and transports the subject in an erect standing posture such that his or her legs may be caused to extend substantially straightly to and in contact with the floor; and when the seat is operatively raised and lowered to a second selected distance from the floor, a sling may be emplaced at the sling connection site and the subject may be enclosed and supported by a sling connected to the assembly.

2. The frontally insertable body hoist seat and sling assembly according to claim 1 wherein the seat comprises a sling connection pin disposed at the sling's connection site as means for sling emplacement.

3. The frontally insertable body hoist seat and sling assembly according to claim 1 wherein the structure the assembly is attached to is a conventional body hoist load arm operable in a vertical plane pivotably from a hoist mast situated upon a floor.

4. The frontally insertable body hoist seat and sling assembly according to claim 3 also comprising a hanger as the seat's attaching means to the hoist's operable load arm;

the hanger comprising in turn a load bearing limb wherein the means of attachment to the load arm is disposed; and a seat supporting limb wherein the means of attachment to the seat is disposed, the disposition of the attachment means comprising attachment of a displacement projection finger to the seat supporting limb at the finger's posterior end, to a hanger attachment bracket at its anterior end and attachment of the hanger attachment bracket to the seat;

the seat supporting limb disposed crooked with reference to the load bearing limb at an angle such that the seat and the subject's center of gravity is disposed inwardly.

5. The frontally insertable body hoist seat and sling assembly according to claim 4, wherein a sling connection pin is disposed at one of:

the anterior end of a displacement projection finger disposed so as to be attached at its posterior end to the seat hanger; and the seat's anterior end, the seat further comprising a recess disposed in its anterior end through which part of the hanger's seat supporting limb extends for attachment to the seat;

whereby the sling connection pin and the center of gravity of the subject enclosed and supported by the sling is disposed inwardly in alignment above an area of base stability.

6. The frontally insertable body hoist seat and sling assembly according to claim 3 wherein the operational controls for the hoist are disposed so as to be operable by the subject.

7. The frontally insertable body hoist seat and sling assembly according to claim 1 wherein the thorax support carriage is disposed to require the subject to lean inward when he or she is seated thereon.

8. The frontally insertable body hoist seat and sling assembly according to claim 1 wherein the thorax support carriage is comprised of a pair of armpit carriage extensions and armpit support pads;

whereby a human subject's thorax may be comfortably supported during lifting and transport.

9. The frontally insertable body hoist seat and sling assembly according to claim 8 wherein each armpit carriage extension and support pad is configured at its posterior extremity with a "C" shaped bend;

whereby the subject's security is enhanced and greater comfort is provided during lifting and transport.

10. A frontally insertable body hoist seat and sling assembly wherein the body hoist load arm is operable in a vertical plane pivotably from the mast of an open bottomed hoist, the assembly comprising;

an elongated seat attached to an operable cantilevered load arm extending from the mast; the seat comprising an anterior end;

a posterior end; and width at its anterior end comprising a range of from three inches to one foot permitting frontal insertion of the posterior end between the legs underneath the buttocks of a human subject;

the assembly further comprising a thorax support carriage;

a sling connection pin disposed at one of:

the anterior end of a displacement projection finger disposed to be attached at its posterior end to the seat hanger; and the seat's anterior end, the seat further comprising a recess disposed in its anterior end through which part of the hanger's seat supporting limb extends for attachment to the seat;

whereby the sling connection pin and the center of gravity of the subject enclosed and supported by the sling is disposed inwardly in alignment above an area of base stability;

the assembly further comprising a hanger as the seat's attaching means to the hoist's operable load arm;

the hanger comprising in turn a load bearing limb wherein the means of attachment to the load arm is disposed; and a seat supporting limb wherein the means of attachment to the seat is disposed;

the seat supporting limb disposed crooked with reference to the load bearing limb at an angle such that the seat and the subject's center of gravity is disposed inwardly;

whereby the seat may be operatively raised and lowered a first selected distance from the floor at which it supports and transports the subject in an erect standing posture such that his or her legs are extending substantially straightly to and in contact with the floor; and the seat may be operatively raised and lowered a second selected distance from the floor at which the subject may be enclosed and supported by a sling connected to the assembly.

* * * * *